United States Patent [19]

Anesi et al.

[11] Patent Number: 4,610,294

[45] Date of Patent: Sep. 9, 1986

[54] DRAPERY ACTUATING MECHANISM HAVING DUAL TIMER

[76] Inventors: Mario Anesi, 551 N. Bonny La., Inverness, Ill. 60067; Fred M. Schwarzer, 5440 N. Ocean Dr. Apt. 1007, Singer Island, Fla. 33404

[21] Appl. No.: 552,765

[22] Filed: Nov. 17, 1983

[51] Int. Cl.[4] ..... A47H 5/02

[52] U.S. Cl. ..... 160/331; 318/486; 307/141

[58] Field of Search ..... 160/1–6, 160/331; 318/283, 285, 484, 485, 486, 487; 307/141, 141.4, 141.8

[56] References Cited

U.S. PATENT DOCUMENTS

| | | | |
|---|---|---|---|
| 1,911,652 | 5/1933 | Starr . | |
| 2,002,268 | 5/1935 | Lassen et al. . | |
| 2,343,951 | 3/1944 | Blodgett . | |
| 2,767,332 | 10/1956 | Willard | 318/486 X |
| 2,848,630 | 8/1958 | McNicol et al. | 318/486 X |
| 2,962,647 | 11/1960 | Borenstein | 318/486 X |
| 3,042,001 | 7/1962 | Dubie et al. | 160/5 |
| 3,235,247 | 2/1966 | Tolson . | |
| 3,269,454 | 8/1966 | Gill et al. | 160/331 |
| 3,429,298 | 2/1969 | Thomason | 160/331 |
| 3,714,457 | 1/1973 | Sweeney | 307/141 |
| 3,802,479 | 4/1974 | Newell, III et al. | 160/1 |
| 3,808,483 | 4/1974 | Kembuegler et al. | 160/331 |
| 3,828,200 | 8/1974 | Gerry | 307/141.8 |
| 3,864,539 | 2/1975 | Hauser | 307/141.8 X |
| 3,925,683 | 12/1975 | Link et al. | 307/141 |
| 4,173,721 | 11/1979 | Lows | 160/176 |
| 4,501,963 | 2/1985 | Perisic | 160/133 X |

*Primary Examiner*—Ramon S. Britts
*Assistant Examiner*—David M. Purol
*Attorney, Agent, or Firm*—Emrich & Dithmar

[57] ABSTRACT

The mechanism has a drive roller which engages the cord that opens and closes a closure member such as a drapery. An electric motor that rotates the driver roller is supplied with power through first and second timed switches. An adjustment associated with the first timed switch may be set to control the times at which power to the electric motor is initiated, while an adjustment associated with the second timed switch may be set to determine the interval after which power to the electric motor is terminated.

10 Claims, 3 Drawing Figures

DRAPERY ACTUATING MECHANISM HAVING DUAL TIMER

BACKGROUND OF THE INVENTION

There have been proposals for devices which will open and close draperies at certain times of the day. These devices may be used in a home in which the occupants are away. In the past, one's drapes are left in one condition, usually closed, for the entire time the occupants are on vacation, for example. While lights may be automatically turned on and off at predetermined times in the day and evening, the constant condition of the drapes may reveal to a would-be burglar that the occupants are away.

Automatic mechanisms to open and close draperies are known. They may be set to open the drapes, for example, at a given time in the morning and close them in the evening.

One such prior device is disclosed in U.S. Pat. No. 3,269,454 to Gill et al. The operation of the mechanism is initiated in accordance with the setting of the timer. Power to the motor is interrupted when tension in the drapery cord exceeds a predetermined value signifying that the draperies have either been fully opened or fully closed. The mechanism disclosed in this patent does not, however, partially open and close drapes, which would be desirable in certain circumstances.

Other patents disclosing mechanisms to open and close a drapery or other closure member include U.S. Pat. Nos. 1,911,652 to Starr, 2,002,268 to Lassen et al., 2,343,951 to Blodgett, 3,042,001 to Dubie et al. and 3,235,247 to Tolson. However, none discloses structure by which the drapery can be opened and closed at selected times during the day to any extent desired.

SUMMARY OF THE INVENTION

It is therefore an important object of the present invention to provide an improved mechanism for automatically opening and closing drapery at selected times.

Another object is to provide a mechanism which completely opens and closes, or partially opens and closes, drapery at selected times.

Another object is to provide a mechanism for automatically opening and closing a closure member, which mechanism has a dual timer to select not only the times of the day the closure member can be opened and closed, but also to select the extent to which the closure member is so opened and closed.

In summary, there is provided a mechanism for opening and closing at least one closure member, a cord being associated with the closure member and having a bight portion and a pair of reaches extending from the bight portion, the mechanism comprising a drive roller for driving engagement with the bight portion of the cord, electric motor means for rotating the drive roller, and first and second timed switching means for selectively supplying power to the electric motor means, the first timed switching means having first adjustment means for setting times at which power to the electric motor means is initiated, the second timed switching means having second adjustment means for setting an interval after which power to the electric motor means is terminated.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purpose of facilitating an understanding of the invention, there is illustrated in the accompanying drawings, a preferred embodiment thereof, from an inspection of which, when considered in connection with the following description, the invention, its construction, and operation, and many of its advantages should be readily understood and appreciated.

DESCRIPTION OF THE PREFERRED EMBODIMENT

Figure 1:
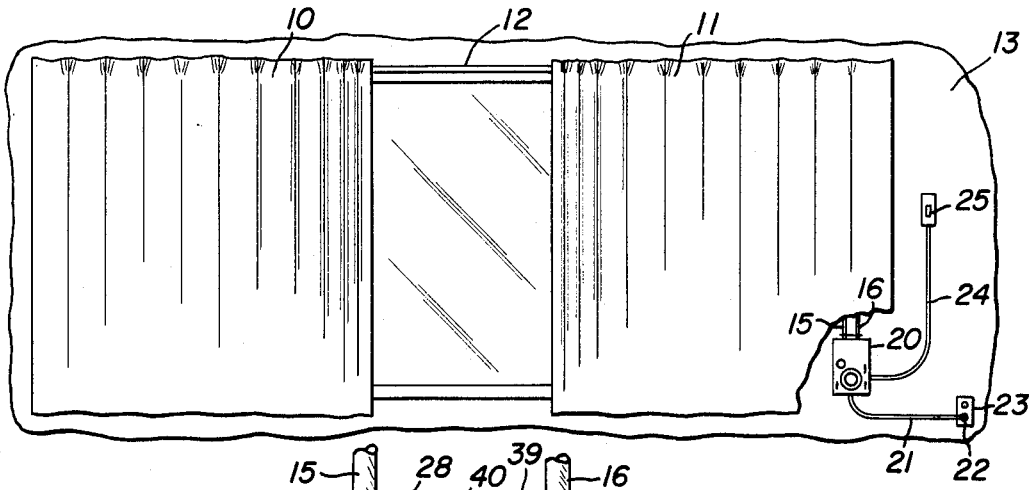
FIG. 1 is an elevational view of a pair of draperies operated by a mechanism incorporating the features of the present invention.

A set of draperies 10 and 11 are illustrated in FIG. 1 as mounted in the usual manner on a drapery rod 12 fixed to a wall 13. A pull cord is operatively connected to the draperies 10 and 11 in such a manner as to define a bight 14 with vertical, parallel reaches 15 and 16 (see FIG. 2). In accordance with standard drapery operating structure, pulling downwardly on one of the reaches opens the draperies, while pulling on the other reach closes the draperies.

There is provided a mechanism 20 which operates to open and close the draperies 10 and 11. A power supply cable 21 for the mechanism 20 is provided with a plug 22 for attachment to an outlet receptacle 23. An electrical cord 24 leads to a single pole, double throw switch 25 which may be mounted on the wall at the normal height of wall switches.

Figure 2:
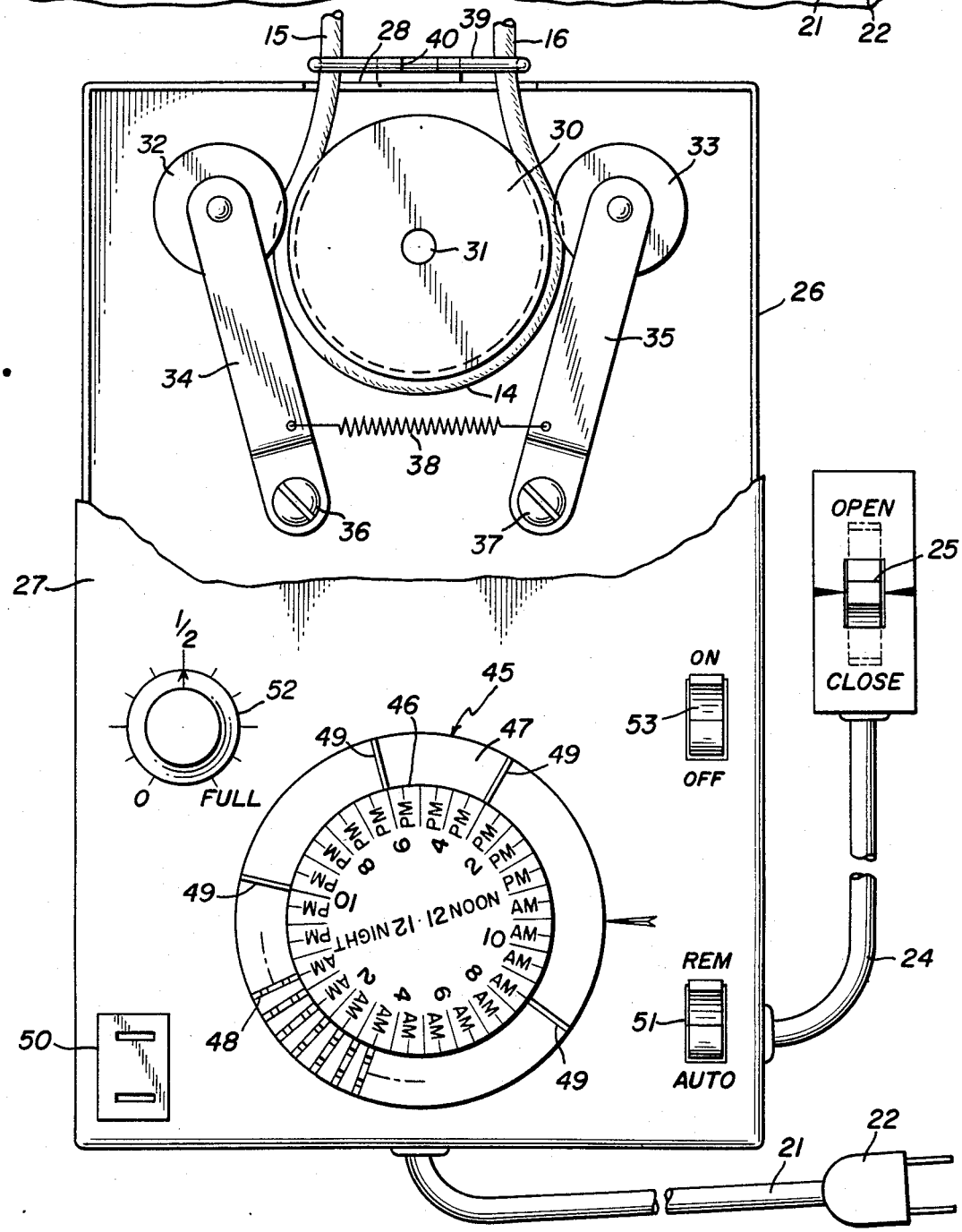
FIG. 2 is an elevational view on an enlarged scale of the mechanism of FIG. 1, with a portion of the front plate broken away to expose some of the internal structure.

Referring to FIG. 2, the mechanism 20 includes a housing 26 and a cover 27 removably attached thereto. The reaches 15 and 16 of the drapery cord pass through a slot 28, the bight 14 embracing a drive roller 30 mounted upon a drive shaft 31, which is mechanically connected to a reversible electric motor 60 (schematically shown in FIG. 3). The reaches 15 and 16 are pinched between the drive roller 30 and a pair of idler pressure rollers 32 and 33 respectively. The rollers 32 and 33 are respectively rotatably mounted on arms 34 and 35 which are pivotally mounted at their other ends to the housing 26 respectively by means of screws 36 and 37. A spring 38, connected between the arms 34 and 35 at points intermediate their ends, biases the arms 34 and 35 toward each other and toward the drive roller 30. Such biasing of the rollers 32 and 33 insures good frictional engagement with the drapery cord. Preferably the drive roller 30 and the idler rollers 32 and 33 are provided with resilient surfacing to cause the cord to be firmly gripped between the rollers 30 and 32 on the one hand and the rollers 30 and 33 on the other hand. There is also provided a C-shaped retainer 39 having a gap 40. The gap 40 enables the reaches 15 and 16 to be inserted into the retainer. The retainer 39 is mounted on top of the housing 26 in alignment with the slot 28, and improves the gripping of the cord by the drive roller 30.

The cord is firmly frictionally driven as the drive roller 30 is rotated by the reversible motor.

The mechanism 20 further comprises a rotatable knob 45 which is part of a first timed switch. The knob 45 has a raised surface 46 bearing indicia corresponding to forty-eight half-hour settings in the day. An outer ring 47 of the knob 45 is flared toward the surface of the cover 27. There are provided forty-eight slots 48 in the ring 47 corresponding to the forty-eight indicia on the surface 46. A plurality of plate-like tabs or pegs 49 are insertable in selected ones of the slots 48. In the particular embodiment shown, four of the pegs 49 are positioned in the four slots 48 adjacent the indicia 8:30 a.m., 3:00 p.m., 6:00 p.m. and 10:00 p.m.

As will be explained in further detail, the knob 45 is rotated by a motor such that it makes one revolution every twenty-four hours. Associated with such motor are contacts which are alternately opened and closed in accordance with the positions of the pegs 49. At each of the times 8:30 a.m., 3:00 p.m., 6:00 p.m., and 10:00 p.m., the contacts close for a time. These contacts are arranged to couple power to the motor that rotates the drive roller 30. In the example shown in FIG. 2, the drapes are automatically opened at 8:30 a.m., closed at 3:00 p.m., opened at 6:00 p.m. and closed at 10:00 p.m. There is also provided an outlet 50, which may be timed to receive power only at certain times.

The mechanism 20 also comprises a single pole, double throw switch 51 having associated therewith the indicia "REM" and "AUTO". When the switch 51 is in the automatic position, the drapes are automatically opened and closed as explained above. In the remote (REM) position, the timed switch 51 is disconnected from the motor and the switch 25 is connected instead. When moved from its rest position (the position shown in FIG. 2) to its open position, power is supplied to the motor which operates the drive roller 30 in a direction to open the drapes 10 and 11. If the switch 25 is moved to its close position, the motor rotates the drive roller 30 in the opposite direction to close the drapes.

In certain situations it is desirable to open and close the drapes 10 and 11 partway. To that end, there is provided a second timed switch, schematically shown in FIG. 3, and including a knob 52. Exemplary indicia on the cover 27 include "0", "½", and "FULL". When the pointer of the knob 52 is turned to the "full" position, the draperies 10 and 11 are fully opened or fully closed, as the case may be, at the appointed times. When the pointer is aligned with the "½" mark, then the draperies 10 and 11 will open (or close) halfway. The extent of opening and closing the draperies 10 and 11 may be increased or decreased in accordance with the setting of the pointer on the knob 52. When power to the motor that rotates the drive roller 30 is initiated by virtue of the settings on the knob 45, the timed switch, of which the knob 52 is part, controls the interval for which the motor is operative. Upon termination of that interval, the drapery opens, or closes as the case may be, no further. It should be appreciated that the knob 52 may be set in accordance with the width of the window. To close or open the drapes on a narrow window, the knob 52 would be placed at a lesser position than for drapes on a wider window. Thus, the same knob 52 enables use of a single mechanism 20 for windows of different widths, and at the same time enables selection of the extent of opening and closing of the drapes.

Following through with the example discussed above, power to the motor is initiated at 8:30 a.m. in accordance with the position of the first peg 49 on the knob 45. This event starts the timed switch with which the knob 52 is associated. After an interval corresponding to the setting of the knob 52, power to the motor is interrupted corresponding to a given opening of the drapes 10 and 11. At 3:00 p.m. the motor will start to rotate in the opposite direction for a time corresponding to the setting of the knob 52. The next peg will cause the drapes to open at 6:00 p.m., then to close at 10:00 p.m., in accordance with the settings of the knob 52.

The mechanism 20 further includes a main on-off switch 53.

Figure 3:
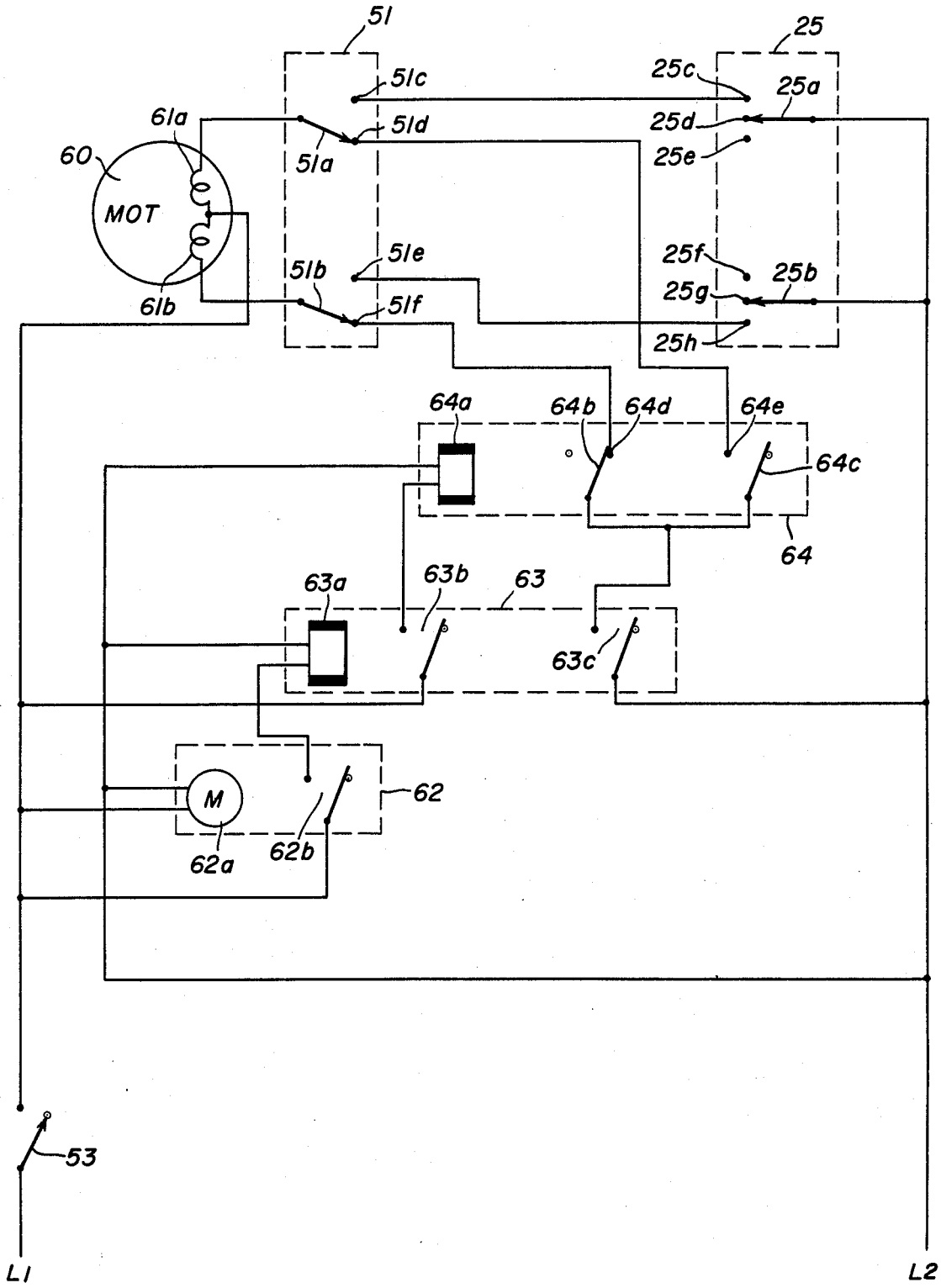
FIG. 3 is a schematic diagram of the electrical circuitry in the mechanism.

Further details of the mechanism 20 will be described by referring to the schematic diagram of FIG. 3. Power to the mechanism 20 is developed across the lines L1 and L2 which are in the cable 21 (FIG. 2). The on-off switch 53 is located in the line L1. The roller 30 is driven by a reversible electric motor 60 having serially connected windings **61*a* and 61*b*, the junction thereof being connected to the switch 53, and the other ends being connected to the switch 51. The switch 51 is a double pole, double throw having movable contacts 51*a* and 51*b* and fixed contacts 51*c*–*f*. In FIG. 3, the switch 51 is in its automatic position. When the contacts 51*a* and 51*b* are moved to engage the contacts 51*e* and 51*c*, respectively, the switch 51 is in the remote position. The contacts 51*c* and 51*e* are connected to the switch 25, specifically the contacts 25*c* and 25*e*, respectively. The switch 25 is of the double throw type, having movable contacts 25*a* and 25*b* connected together and to the L2 line. Assuming the switch 51 is in the manual position, movement of the switch 25 to the "open" position causes the contact 25*a* to engage the contact 25*c*, thereby completing a circuit through the winding 61*a*, thereby energizing the motor 60. The motor 60 will rotate until the switch 25 is returned to its neutral condition. When the switch 25 is placed in its "close" position, the contacts 25*b* and 25*h* are caused to engage thereby causing power to be supplied to the winding 61*b* of the motor 60. The motor 60 rotates in the opposite direction to rotate the drive roller 30 to close the drapes 10 and 11. Again the motor 60 continues to operate until the switch 25** is returned to its neutral condition.

When the switch 51 is placed in its "AUTO" position, that is, the condition shown in FIG. 3, the dual-timer circuitry is connected in the circuit, which is constructed and operates as follows.

The mechanism 20 comprises a first timed switch 62 having a motor **62*a* and a pair of contacts 62*b*. The motor 62*a* rotates an actuator (not shown) which closes the contacts 62*b* in accordance with the settings of the pegs 49. The timed switch 62** may be an INTERMATIC brand timer, model no. WG-630.

The mechanism 20 further comprises a second timed switch 63 having a relay winding **63*a* and two normally opened pairs of contacts 63*b* and 63*c*. Energization of the winding 63*a* closes the contacts 63*b* and 63*c* for a time dependent on the setting of the knob 52 which is part of the switch 63. If the knob 52 is set at "½", the contacts 63*b* and 63*c* will stay closed for a given duration. They will stay closed for twice that interval if the knob 52 is at its "full" position. Power to the winding 63*a* is coupled through the contacts 62*b*, the closure of which is dependent on the settings of the knob 45. The second timer switch 63** may be one obtained from National Controls Corp. of Addison, Ill., model no. T24-

10-461 providing a variable closure time between one and ten seconds.

The mechanism 20 further comprises a latching relay 64 having a winding 64*a*, movable contacts 64*b* and 64*c*, and fixed contacts 64*d* and 64*e*. When power is delivered to the winding 64*a*, the contacts 64*e,c* close, and the contacts 64*b,d* open. The contacts remain in this condition until power to the winding 64*a* is interrupted and then later initiated. The next time the winding 64*a* is energized, the contacts 64*b,d* open and the contacts 64*e,c* close. The contacts 64*d* and 64*e* are respectively coupled to the contacts 51*f* and 51*d* of the switch 51.

In the following exemplary description of the operation of the mechanism 20, it will be assumed that the switch 51 is in the "AUTO" condition and the main power switch 53 is closed. Power is thereby delivered to the motor 62*a*. At 8:30 a.m. the contacts 62*b* close, supplying power to the winding 63*a*. The contacts 63*b* close thereby energizing the winding 64*a* of the latching relay 64 which in turn causes closure of the contacts 64*c,e*. The energization of the winding 63*a* also closes the contacts 63*c* for a time determined by the setting of the knob 52. Power is thus supplied through the contacts 63*c* and the contacts 64*c,e* to the winding 61*a*. The motor 60 will be caused to rotate for a duration in accordance with the setting of the knob 52 and in a direction to open the drapes 10 and 11. After completion of the interval determined by the setting of the knob 52, the contacts 63*c* open thereby disrupting power to the motor 60.

At 3:00 p.m. in accordance with the second peg on the knob 45, the contacts 62*b* again close, energizing the winding 63*a*. The contacts 63*b* close to energize the relay winding 64*a*, causing closure of the contacts 64*b,d* and opening the contacts 64*c,e*. The contacts 63*c* are closed for the duration set by the knob 52, to complete a path through the contacts 64*b,d*, to energize the winding 61*b*, causing the motor 60 to rotate in a direction to close the drapes 10 and 11.

At 6:00 p.m. the third peg 49 causes the motor 62*a* to close the contacts 62*b* thereby energizing the relay winding 63*a*. the relay 64 is thus caused to close the contacts 64*a*, 64*e*. Power is supplied through the now-closed contacts 63*c* for a time determined by the setting of the knob 52 to supply power to the winding 61*a*. The motor 60 rotates to open the draperies by an amount determined by the setting of the knob 52. Finally, at 10:00 p.m. the motor 62*a* again closes the contacts 62*b* to energize the switch 63. The contacts 63*b* which are thereby closed energize the relay winding 64*a* causing the contacts 64*b* and 64*d* to close and causing power to be supplied to the winding 61*b* of the motor 60, again for the time determined by the setting of the knob 52. The drapes 10 and 11 are thereby caused to close an amount determined by the setting of the knob 52.

Although the timed switches 62 and 63 are shown to be mechanical, it is to be understood that that is merely exemplary. The timed switches 62 and 63 and the stepping relay 64 all can be replaced with electronic multivibrators, for example.

What has been described therefore is an improved mechanism for opening and closing draperies at preset times of the day in which the amount that the draperies open or close is controlled by a second timer.

We claim:

1. A mechanism for opening and closing at least one closure member, a cord being associated with the closure member and having a bight portion and a pair of reaches extending from the bight portion, said mechanism comprising a drive roller for driving engagement with the bight portion of the cord, electric motor means having first and second winding portions for respectively rotating said drive roller in opposite directions, first and second timed switching means for selectively supplying power to said electric motor means, said first timed switching means having first adjustment means for setting times at which power to said electric motor means is initiated, said second timed switching means having second adjustment means for setting an interval after which power to said electric motor means is terminated, each of said timed switching means including at least one pair of contacts and control means for selectively opening and closing the assocaited pair of contacts, and third switching means having first and second sets of contacts respectively disposed in opposite conditions and direction control means for controlling the conditions of said sets of contacts, the control means of said first timed switching means being coupled across a source of power and being operative to close its associated pair of contacts for selected durations in accordance with the setting of said first adjustment means, the contacts of said first timed switching means being coupled in series with the source of power and the control means of said second timed switching means, the contacts of said second timed switching means being coupled in series with the source of power and said direction control means, said first set of contacts being coupled in series with the source of power and said first winding portion, said second set of contacts being coupled in series with the source of power and said second winding portion, said direction control means being responsive to said second timed switching means for reversing the conditions of said first and second sets of contacts each time said second time switching means is actuated, whereby said motor means is caused to rotate in a direction opposite to its direction of rotation the previous time power was supplied to said electric motor means.

2. The mechanism of claim 1, and further comprising means responsive to said second timed switching means for preparing said electric motor means to rotate in a direction opposite to its direction of rotation the previous time power was supplied to said electric motor means.

3. The mechanism set forth in claim 1, wherein said third switching means is a relay, and said direction control means is a winding of said relay.

4. The mechanism of claim 1, and further comprising two pivotally mounted arms respectively carrying two idler wheels located adjacent to and on opposite sides of said drive roller, and biasing means for urging said idler wheels against said drive roller to maintain good driving engagement of said driver roller with the bight portion of the cord.

5. The mechanism of claim 4, wherein each arm is pivotally mounted adjacent to one end thereof and the associated idler wheel is carried by the associated arm adjacent to the other end thereof, said biasing means being attached to each arm at a point intermediate the ends thereof.

6. The mechanism of claim 5, wherein said biasing means is a spring attached to said arm.

7. The mechanism of claim 1, and further comprising manual switching means including first and second pairs of contacts, said first and second pairs of contacts having opened and closed conditions and being in opposite conditions, said first pair of contacts being coupled in series with a source of power and said first winding portion, said second pair of contacts being coupled in series with a source of power and said second winding portion, whereby placing said first and second pairs of contacts in one set of conditions will cause the said motor means to rotate in one direction, and placing said first and second pairs of contacts in the opposite set of conditions will cause said motor means to rotate in an opposite direction.

8. The mechanism of claim 1, and further comprising first manual switching means for selectively supplying power to said electric motor means, and second manual switching means selectively coupling said first manual switching means and said third switching means to said electric motor means, said second manual switching means having a first condition whereby said first manual switching means is coupled in circuit with said electric motor means, and having a second condition whereby said third switching means is coupled in circuit with said electric motor means.

9. The mechanism set forth in claim 1, wherein said second timed switching means has two pairs of contacts, one of said pairs of contacts being coupled in series with said direction control means and the other of said pairs of contacts being connected in series with both of said first and second sets of contacts of said third switching means.

10. In a mechanism for opening and closing at least one closure member, a cord being associated with the closure member and having a bight portion and a pair of reaches extending from the bight portion, the mechanism comprising a drive roller for driving engagement with the bight portion of the cord, and electric motor means having first and second winding portions for respectively rotating said drive roller in opposite directions, the improvement comprising: first and second timed switching means for selectively supplying power to said electric motor means, said first timed switching means having first adjustment means for setting times at which power to said electric motor means is initiated, said second timed switching means having second adjustment means for setting an interval after which power to said electric motor means is terminated, each of said timed switching means including at least one pair of contacts and control means for selectively opening and closing the associated pair of contacts, and third switching means having first and second sets of contacts respectively disposed in opposite conditions and direction control means for controlling the conditions of said sets of contacts, the control means of said first timed switching means being coupled across a source of power and being operative to close its associated pair of contacts for selected durations in accordance with the setting of said first adjustment means, the contacts of said first timed switching means being coupled in series with the source of power and the control means of said second timed switching means, the contacts of said second timed switching means being coupled in series with the source of power and said direction control means, said first set of contacts being coupled in series with the source of power and said first winding portion, said second set of contacts being coupled in series with the source of power and said second winding portion, said direction control means being responsive to said second timed switching means for reversing the conditions of said first and second sets of contacts each time said second time switching means is actuated, whereby said motor means is caused to rotate in a direction opposite to its direction of rotation the previous time power was supplied to said electric motor means.

* * * * *